US010017988B2

(12) United States Patent
Smith

(10) Patent No.: US 10,017,988 B2
(45) Date of Patent: Jul. 10, 2018

(54) FOLDABLE WALKWAY

(71) Applicant: AIMS INTERNATIONAL, INC., Houston, TX (US)

(72) Inventor: Mikael W. Smith, Kingwood, TX (US)

(73) Assignee: AIMS INTERNATIONAL, Houston, TX (US)

( * ) Notice: Subject to any disclaimer, the term of this patent is extended or adjusted under 35 U.S.C. 154(b) by 139 days.

(21) Appl. No.: 14/951,830

(22) Filed: Nov. 25, 2015

(65) Prior Publication Data

US 2016/0145939 A1 May 26, 2016

Related U.S. Application Data

(60) Provisional application No. 62/084,990, filed on Nov. 26, 2014.

(51) Int. Cl.

| | |
|---|---|
| ***E06C 1/393*** | (2006.01) |
| ***E04G 1/34*** | (2006.01) |
| ***E06C 7/16*** | (2006.01) |
| ***E06C 7/50*** | (2006.01) |
| *E04G 5/14* | (2006.01) |
| *E06C 7/18* | (2006.01) |

(52) U.S. Cl.

CPC ..... *E06C 1/393* (2013.01); *E04G 1/34* (2013.01); *E06C 7/16* (2013.01); *E06C 7/50* (2013.01); *E04G 5/14* (2013.01); *E06C 7/181* (2013.01)

(58) Field of Classification Search

CPC ..... E01D 15/124; E04F 11/062; E04F 11/09; E04F 11/06; E06C 1/39; E06C 1/393; E06C 1/14; E06C 1/16; E06C 1/18; E06C 1/20; E06C 1/22; E06C 1/38; E06C 1/383; E06C 7/00; E06C 7/06; E06C 7/16; E06C 7/18; E06C 7/181; E06C 7/182; E06C 7/183; E06C 7/50

See application file for complete search history.

(56) References Cited

U.S. PATENT DOCUMENTS

| | | | | | |
|---|---|---|---|---|---|
| 826,582 | A * | 7/1906 | Laird | E06C 1/393 | 182/124 |
| 4,004,652 | A * | 1/1977 | Laboy-Alvarado | E01D 15/124 | 182/1 |
| 4,520,896 | A * | 6/1985 | Disston | E06C 1/22 | 182/156 |
| 5,246,085 | A * | 9/1993 | Liegel | E04G 1/34 | 182/113 |

(Continued)

*Primary Examiner* — Daniel P Cahn

(74) *Attorney, Agent, or Firm* — Edmonds & Cmaidalka, PC

(57) ABSTRACT

A foldable walkway may include a platform having a first end and a second end longitudinally opposite the first end, a ladder pivotally coupled to the first end via a first pair of pivot joints, and a pair of supports pivotally coupled to the second end via a second pair of pivot joints. The ladder and the platform are configured to be manually pivoted about the respective first and second pairs of pivot joints. The ladder includes a first portion pivotally coupled to the first end of the platform via the first pair of pivot joints, a second portion movably coupled to the first portion to increase or decrease an extent of the ladder, and a spring having a first end coupled to the first portion and a second end coupled to the second portion.

7 Claims, 5 Drawing Sheets

(56) References Cited

U.S. PATENT DOCUMENTS

| | | | | | |
|---|---|---|---|---|---|
| 5,368,126 | A * | 11/1994 | Woodward | E04G 1/20 | 182/118 |
| 5,669,463 | A * | 9/1997 | Robertson | E06C 1/39 | 182/115 |
| 5,746,288 | A * | 5/1998 | O'Neal | E04G 1/34 | 182/118 |
| 8,042,653 | B2 * | 10/2011 | Grebinoski | E04G 1/15 | 182/223 |
| 8,113,316 | B2 * | 2/2012 | Sward | G01N 33/497 | 108/62 |
| 8,186,480 | B1 * | 5/2012 | Yoakum, Jr. | E06C 1/39 | 182/118 |
| 9,404,305 | B1 * | 8/2016 | Messick | E06C 7/16 | |
| 9,422,768 | B2 * | 8/2016 | Yoo | E06C 1/393 | |
| 9,879,480 | B2 * | 1/2018 | Gallup | E06C 1/383 | |
| 2004/0129497 | A1 * | 7/2004 | Weiss | E06C 1/32 | 182/163 |
| 2009/0007348 | A1 * | 1/2009 | Woodmansee, III | E01D 15/124 | 14/2.4 |
| 2009/0095567 | A1 * | 4/2009 | Rinna | E04G 1/30 | 182/124 |
| 2010/0071995 | A1 * | 3/2010 | Campbell, Jr. | E06C 1/39 | 182/115 |
| 2010/0071996 | A1 * | 3/2010 | Huang | E04G 1/34 | 182/118 |
| 2010/0281635 | A1 * | 11/2010 | Hemby | E01D 15/133 | 14/69.5 |
| 2011/0056764 | A1 * | 3/2011 | Cross | E06C 1/32 | 182/27 |
| 2014/0274571 | A1 * | 9/2014 | Aral Diaz | A63B 17/00 | 482/37 |
| 2017/0226803 | A1 * | 8/2017 | Russell | E06C 1/393 | |

* cited by examiner

FOLDABLE WALKWAY

BACKGROUND

Conventional walkways used on offshore marine facilities (e.g., offshore production facility) are electrically powered. However, electrical power available on the offshore marine facilities may be limited and essential equipment onboard the offshore marine facilities, such as drilling machines, extraction machines, may be given priority over other equipment with respect to electrical power available. Also, conventional walkways require a substantial storage space, which may not be available on the offshore marine facilities.

What is then required is a walkway that is compact, occupies relatively less storage space and which requires a minimum amount of electricity for operation.

SUMMARY

Embodiments of the disclosure may provide a foldable walkway including a platform having a first end and a second end longitudinally opposite the first end, a ladder pivotally coupled to the first end via a first pair of pivot joints and configured to be manually pivoted about the first pair of pivot joints, and a pair of supports pivotally coupled to the second end via a second pair of pivot joints. The platform may provide a surface for traversing the foldable walkway and may be manually pivoted about the second pair of pivot joints. The ladder may include a first portion pivotally coupled to the first end via the first pair of pivot joints, a second portion movably coupled to the first portion to increase or decrease an extent of the ladder, and a spring having a first end coupled to the first portion and a second end coupled to the second portion. The foldable walkway may further include a cylindrical shaft disposed at or adjacent the second end of the platform, a handrail post coupled at or adjacent each corner of the platform, and a bolt assembly disposed on an outer surface of the platform between each longitudinally opposite handrail posts and configured to prevent the ladder from pivoting. Each axial end of the cylindrical shaft may be supported by the platform and the pair of supports. The bolt assembly may include a bolt, one or more guide blocks configured to support the bolt, and a receiver configured to capture the bolt.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
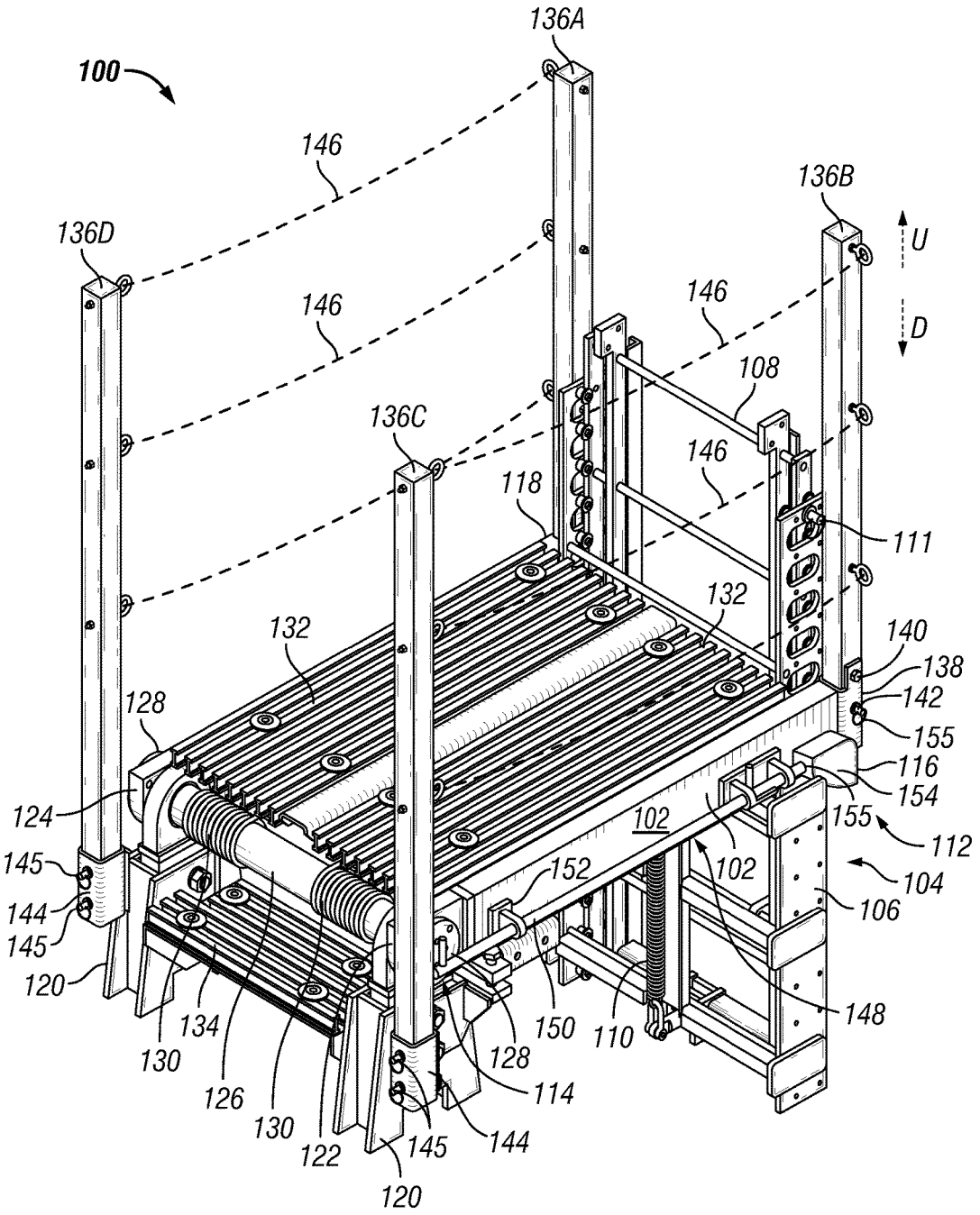
FIG. 1 illustrates a front, perspective view of a foldable walkway in an open position, according to embodiments disclosed.

It is to be understood that the following disclosure describes several embodiments for implementing different features, structures, or functions of the invention. Embodiments of components, arrangements, and configurations are described below to simplify the present disclosure; however, these embodiments are not intended to limit the scope of the invention. Additionally, the present disclosure may repeat reference numerals and/or letters in the various embodiments and across the Figures provided herein. This repetition is for the purpose of simplicity and clarity and does not in itself dictate a relationship between the various embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, i.e., any element from one embodiment may be used in any other embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a front, perspective view of a foldable walkway 100 in an open position, according to embodiments disclosed. The foldable walkway 100 may include a platform 102, a ladder 104, a first pair of pivot joints 116, 118, a second pair of pivot joints 122, 124, a pair of supports 120, and four handrail posts 136A, 136B, 136C, 136D, each coupled to the platform 102 at or adjacent a corner thereof. The foldable walkway 100 may be opened or closed manually and may not require electrically powered mechanisms, e.g., hydraulically or pneumatically operated mechanisms. The foldable walkway 100 may be folded into a relatively compact structure compared to existing walkways, and may thus require relatively less storage space.

The platform 102 may have any shape and dimension. For example, the platform 102 may be generally rectangular, meaning its length is longer than its width. The platform 102 may support one or more (two shown) gratings 132. The gratings 132 may form the floor of the foldable walkway 100 thus providing a surface for personnel to traverse the foldable walkway 100. One end 112 of the platform 102 may be pivotally coupled to the ladder 104 via the first pair of pivot joints 116, 118. A second end 114 of the platform 102 longitudinally opposite to the first end 112 may be pivotally coupled to the pair of supports 120 via the second pair of pivot joints 122, 124. As illustrated, each pivot joint 116, 118 may be located at a corner at the end 112 of the platform 102. Similarly, each pivot joint 122, 124 may be located at a corner at the end 114 of the platform 102.

The ladder 104 may include a first section 106 and a second section 108. The first section 106 may be pivotally coupled to the platform 102 via the first pair of pivot joints 116, 118. The second section 108 may be movably coupled to the first section 106. For instance, the second section 108 may be mounted on the first section 106 such that the second section 108 may advance or slide up and down (indicated by arrows U and D in FIG. 1) on the first section 106, thereby increasing or decreasing an extent of the ladder 104. A spring 110 may couple the first section 106 and the second section 108 to each other. One end of the spring 110 may be coupled to the second section 108 while the opposite end thereof may be coupled to the first section 106. During operation, after the second section 108 has been extended a desired distance, the second section 108 may be locked in position using a locking pin 111. For instance, the locking pin 111 may be inserted through holes defined in the first section 106 and the second section 108.

Each support 120 may be pivotally coupled to a corner of the platform 102 at the end 114 thereof. The second pair of pivot joints 122, 124 may include a cylindrical shaft 126 that is supported by the platform 102 and each support 120. A pair of springs 130 may be disposed on the cylindrical shaft 126. One end of each spring 130 may be coupled to the platform 102 and the other end of each spring 130 may be coupled to a respective support 120. An axial movement of the cylindrical shaft 126 may be restricted via shaft caps 128 coupled to the platform 102 at or adjacent the pivot joints 122, 124.

The foldable walkway 100 may include a step or footing 134 for accessing the platform 102. For example, one or more gratings may be coupled to the pair of supports 120 and may provide the step or footing 134 of the foldable walkway 100. The step or footing 134 also may be a solid plate or solid surface, such as a steel plate for instance.

Each handrail post 136A, 136B may be pivotally coupled via pivot joints 140 to respective brackets 138 attached to the platform 102. The handrail posts 136A, 136B may be locked in position using a locking pin 142. For instant, the locking pin 142 may be inserted through holes in the brackets 138 and the handrail posts 136A, 136B. Each handrail post 136C, 136D may be coupled to respective brackets 144 via one or more locking pins 145. The handrail posts 136C, 136D may not be pivotable (compared to the handrail posts 136A, 136B). One or more cables 146 may extend between handrail posts 136A and 136D, and between handrail posts 136B and 136C. The cables 146 may provide support to personnel traversing the foldable walkway 100 and/or prevent personnel from straying over the edge of the foldable walkway 100.

A bolt assembly 148 (see also FIG. 2B) may be disposed on the outer surface of the platform 102 between handrail posts 136B and 136C. Another bolt assembly may be disposed on the opposite outer surface of the platform 102 between handrail posts 136A and 136D. The bolt assembly may secure the ladder 104 either in the substantially vertical position (shown in FIG. 1) or in a substantially horizontal position (shown in FIGS. 2A, 2B). The bolt assembly 148 may be or include a bolt 150, one or more guide blocks 152, and a receiver 154. The one or more guide blocks 152 may be any component or part that may be capable of supporting the bolt 150 and permitting the bolt 150 to move or slide therein. For example, the one or more guide blocks 152 may define grooves or holes in which the bolt 150 may be disposed and in which the bolt 150 may move. The receiver 154 may be any component or part capable of capturing and securing the bolt 150. For example, as illustrated, the receiver 154 may be quarter-circular in shape and may define one or more holes 155 on the outer surface thereof that may receive the bolt 150. The receiver 154 may be coupled to the pivot joints 116, 118 such that the receiver 154 may at least partially rotate when the ladder 104 is pivoted. The receiver 154 may rotate such that one of the holes 155A may receive the bolt 150 when the ladder in is an upright or vertical position, while the other hole 155B may receive the bolt 150 when the ladder is in a horizontal position. A self-locking clamp may be used to manipulate the bolt 150 to and from the receiver 154 and to secure the bolt 150 into a locked position within the receiver 154 during use.

Figure 2A:
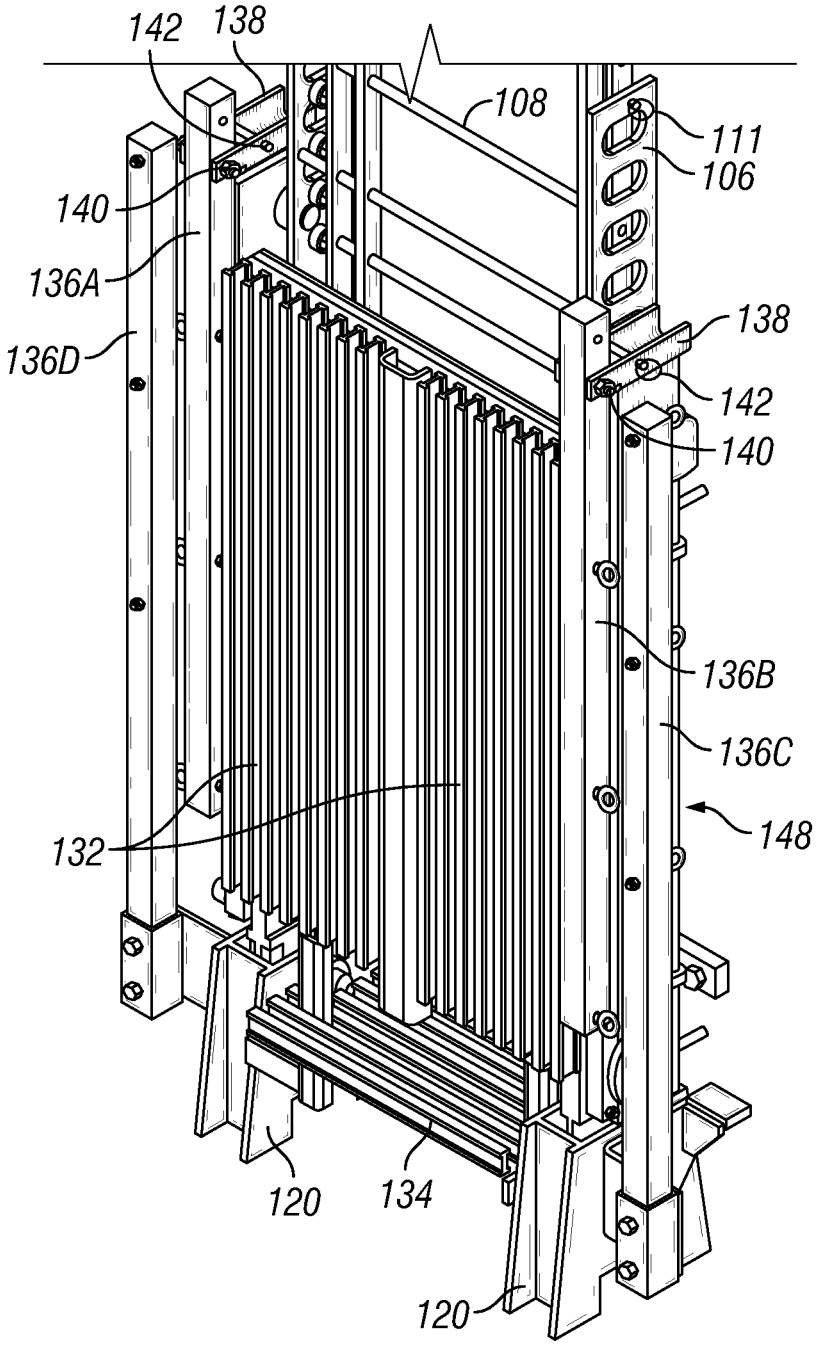
FIG. 2A illustrates a front, perspective view of the foldable walkway of FIG. 1 in a closed position, according to embodiments disclosed.
Figure 2B:
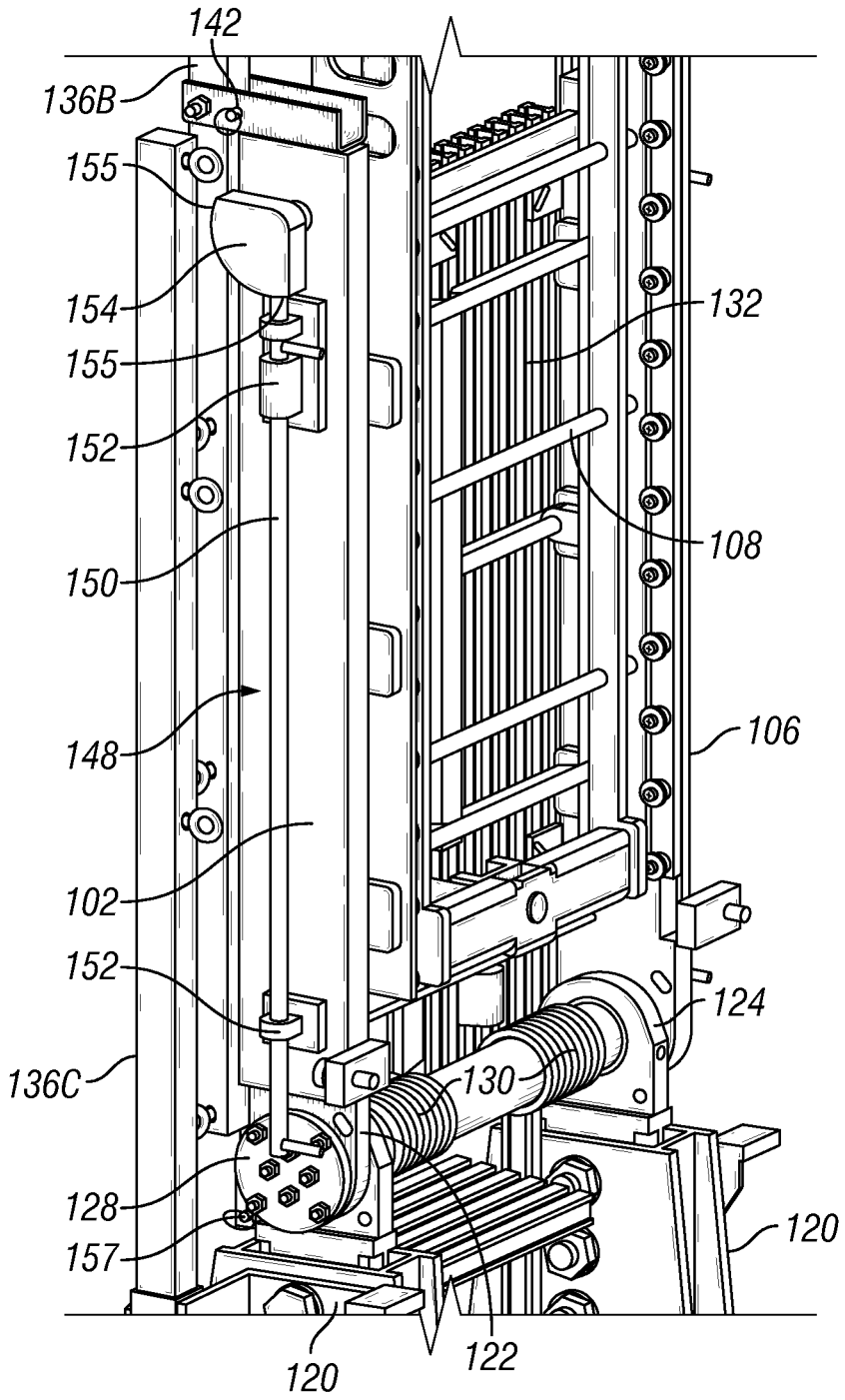
FIG. 2B illustrates a rear, perspective view of the foldable walkway of FIG. 1 in the closed position, according to embodiments disclosed.
Figure 2C:
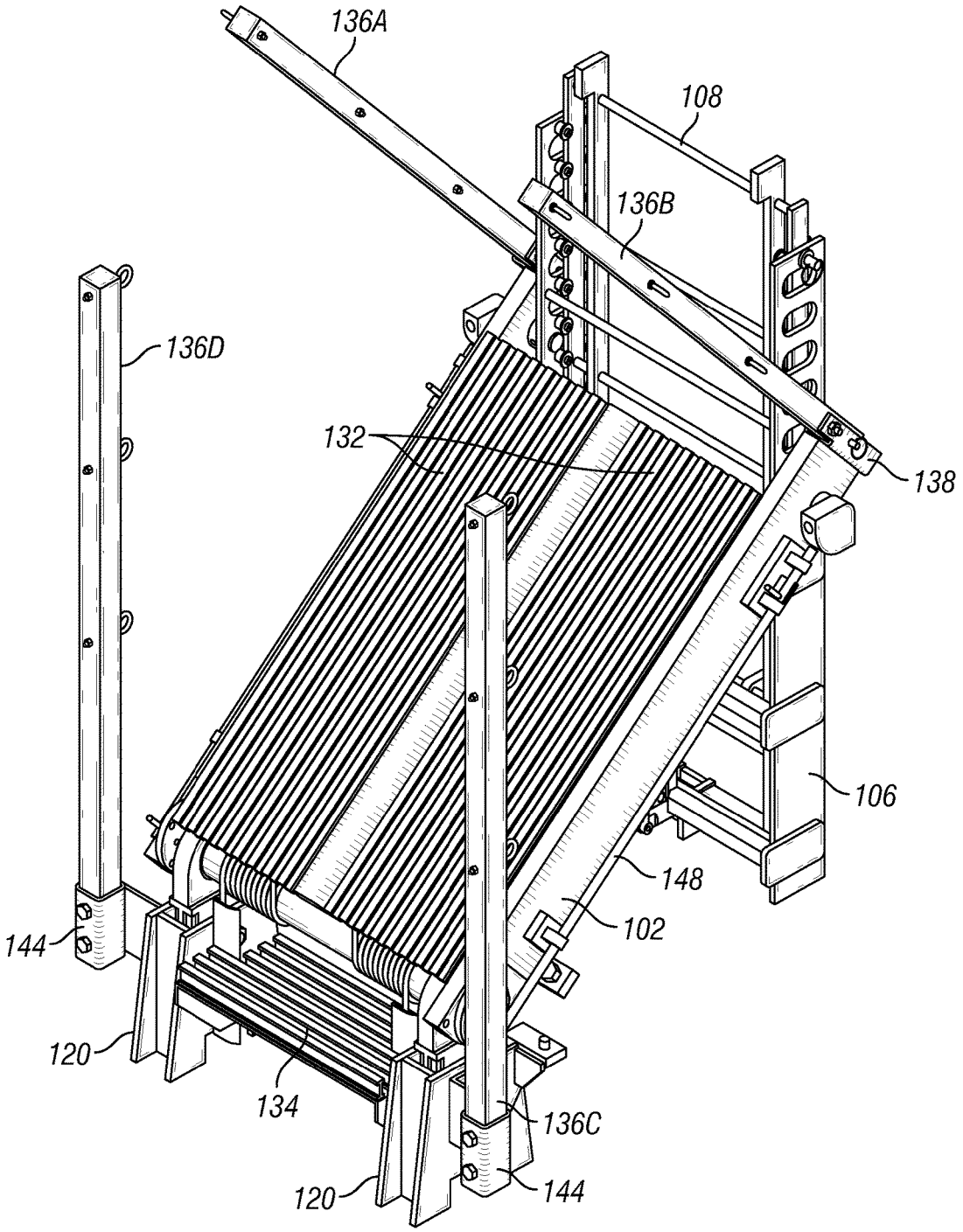
FIG. 2C illustrates a front, perspective view of the foldable walkway of FIG. 1 in a partially open position, according to embodiments disclosed.

FIG. 2A illustrates a front, perspective view of the foldable walkway 100 in a closed (or folded) position, according to embodiments disclosed. FIG. 2B illustrates a rear, perspective view of the foldable walkway 100 in the closed position, according to embodiments disclosed. FIG. 2C illustrates a front, perspective view of the foldable walkway 100 in a partially open position (or, a partially closed position), according to embodiments disclosed. In the closed position, the platform 102 may be considered to be in a substantially vertical position (compared to the substantially horizontal position in FIG. 1) and the ladder 104 may be considered to be in a substantially parallel to the platform 102 (compared to being substantially perpendicular to the platform 102 in FIG. 1).

In order to place the foldable walkway 100 in the closed position from the open position, the locking pins 142 may be removed and the handrail posts 136A, 136B may be pivoted about the pivot joints 140 and placed in a substantially horizontal position parallel to the platform 102. The locking pins 142 may be inserted in the brackets 138 to hold the handrail posts 136A, 136B in the substantially horizontal position.

Locking pins 157 which may be placed in the second pair of pivot joints 122, 124 to secure the platform 102 in a desired horizontal or vertical position may be removed. The bolt assembly 148 may be disengaged (e.g., the bolt 150 is removed from the receiver 154). The platform 102 may be pivoted about the pivot joints 122, 124 and placed in the substantially vertical position. The bolt assembly 148 may be engaged (e.g., the bolt 150 is inserted in the receiver 154) and the locking pins 157 may be reinserted in the pivot joints 122, 124 to secure the platform 102 in the substantially vertical position.

In an embodiment, prior to placing the platform 102 in the substantially vertical position, the bolt assembly 148 may be disengaged and the ladder 104 may be pivoted about the first pair of pivot joints 116, 118 to place the ladder 104 in a substantially horizontal position parallel to the platform 102. The bolt assembly 148 may be engaged to secure the ladder 104 in the substantially horizontal position. In another embodiment, the locking pins 157 may be removed and the bolt assembly 148 may be disengaged, and the platform 102 and the ladder 104 may be simultaneously pivoted. In still another embodiment, the platform 102 and/or the ladder 104 may be placed in the substantially vertical position prior to placing the handrail posts 136A, 136B in the substantially horizontal position. It will be understood that one or more of the above steps may be carried out in reverse to open the foldable walkway 100 from the closed position, and will thus be omitted herein for the sake of brevity.

Figure 3:
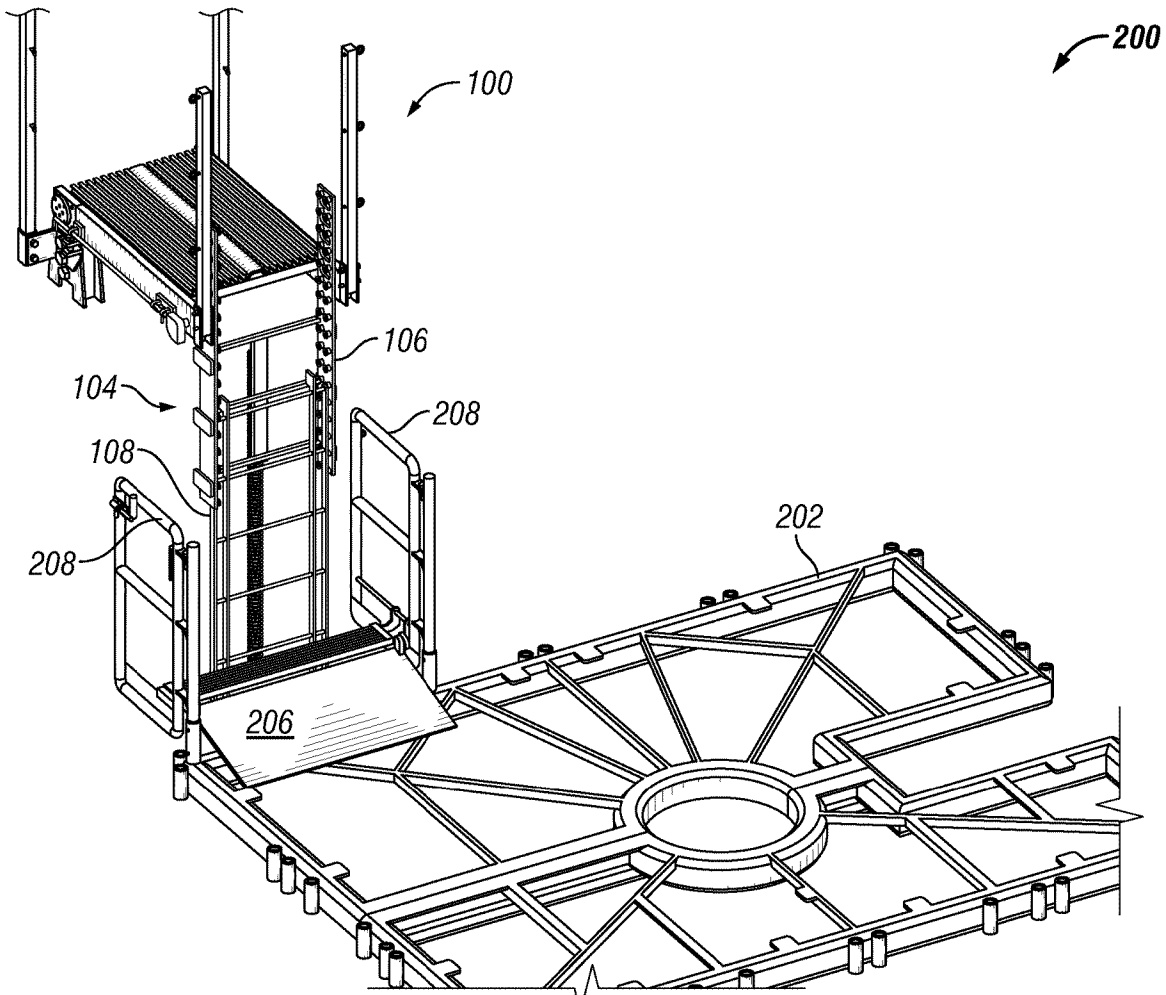
FIG. 3 illustrates a partial, perspective view of an offshore marine facility with the foldable walkway of FIG. 1 positioned adjacent thereto, according to embodiments disclosed.

FIG. 3 illustrates a partial perspective view of an offshore marine facility 200 having the foldable walkway 100 disposed adjacent thereto, according to embodiments disclosed. The offshore marine facility 200 may include a work platform 202 having one or more gates 208 coupled thereto. A walkway assembly 206 may be coupled to the one or more gates 208 and may provide a surface for personnel to traverse to access the work platform 202. In order to access the work platform 202, the foldable walkway 100 may be positioned at or adjacent the one or more gates 208. If required, the ladder 104 may be extended to the walkway assembly 206 and personnel may access the work platform 202 via the walkway assembly 206.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A foldable walkway comprising:

a platform having a first end and a second end longitudinally opposite the first end, the platform having a major length defined between the first and second ends of the platform and providing a surface for a user traversing the foldable walkway;

a ladder pivotally coupled to the first end of the platform via a first pair of pivot joints and configured to be manually pivoted about the first pair of pivot joints, wherein the ladder comprises:

a first portion pivotally coupled to the first end of the platform via the first pair of pivot joints, and a second portion movably coupled to the first portion to increase or decrease a major length of the ladder; and the walkway further comprising a pair of supports pivotally coupled to the second end of the platform via a second pair of pivot joints, the platform configured to be manually pivoted about the second pair of pivot joints;

a cylindrical shaft disposed at or adjacent the second end of the platform, the cylindrical shaft being supported by the platform and the pair of supports;

a first handrail post coupled to the platform; and a bolt assembly disposed on an outer surface of the platform and disposed between two additional handrail posts, the bolt assembly configured to prevent the ladder from pivoting, the bolt assembly comprising:

a bolt having a major length substantially parallel with the major length of the platform and configured to slide along the major length of the platform, at least one guide block supporting the bolt on the outer surface of the platform, and a receiver pivotally fixed on one pivot joint of the first pair of pivot joints, the receiver having an upper aperture and a lower aperture respectively configured to capture the bolt, wherein the major length of the platform is secured in a substantially horizontal position when the ladder is in a substantially vertical position as the bolt is inserted in the upper aperture, and wherein the major length of the platform is secured in a substantially vertical position when the ladder is in the substantially vertical position as the bolt is inserted in the lower aperture.

2. The foldable walkway of claim 1, wherein the receiver of the bolt assembly is fixedly coupled to said one pivot joint of the first pair of pivot joints such that pivoting the ladder at least partially rotates the receiver.

3. The foldable walkway of claim 1, further comprising a first spring and a second spring disposed on the cylindrical shaft, wherein:

a first end of each of the first spring and the second spring is coupled to the platform, and a second end of the first spring is coupled to a first support of the pair of supports and a second end of the second spring is coupled to a second support of the pair of supports.

4. The foldable walkway of claim 1, further comprising a shaft cap coupled to the platform to prevent axial movement of the cylindrical shaft.

5. The foldable walkway of claim 1, further comprising one or more gratings disposed on the platform, the one or more gratings providing the surface of the platform.

6. The foldable walkway of claim 1, wherein the ladder and the platform are configured to pivot simultaneously about the respective first and second pairs of pivot joints.

7. A foldable walkway comprising:

a platform having a first end and a second end longitudinally opposite the first end, the platform having a major length defined between said first and second ends, and the platform providing a surface for a user traversing the foldable walkway;

a ladder pivotally coupled to the first end of the platform via a first pair of pivot joints and configured to be manually pivoted about the first pair of pivot joints, wherein the ladder comprises:

a first portion pivotally coupled to the first end of the platform via the first pair of pivot joints, and a second portion movably coupled to the first portion, wherein the second portion is configured to move up or down on the first portion to increase or decrease a major length of the ladder; and the walkway further comprising a pair of supports pivotally coupled to the second end of the platform via a second pair of pivot joints, the platform configured to be manually pivoted about the second pair of pivot joints;

one or more gratings disposed on the platform, the one or more gratings providing the surface of the platform;

a cylindrical shaft disposed at or adjacent the second end of the platform, the cylindrical shaft being supported by the platform and the pair of supports;

a first handrail post coupled to the platform; and a bolt assembly disposed on an outer surface of the platform and disposed between two additional handrail posts, the bolt assembly configured to prevent the ladder from pivoting, the bolt assembly comprising:

a bolt having a major length substantially parallel with the major length of the platform and configured to slide along the major length of the platform, at least one guide block supporting the bolt on the outer surface of the platform, and a receiver pivotally fixed on one of the first pair of pivot joints, the receiver having an upper aperture and a lower aperture respectively configured to capture the bolt, wherein the walkway is in a use configuration when the major length of the platform is secured in a substantially horizontal position when the ladder is in a substantially vertical position as the bolt is inserted in the upper aperture, wherein the walkway is in a folded configuration when the major length of the platform is secured in a substantially vertical position when the ladder is in the substantially vertical position as the bolt is inserted in the lower aperture, and wherein the ladder and the platform are configured to pivot about the first and second pairs of pivot joints respectively such that the ladder and the platform are substantially parallel to each other when the walkway is in the folded configuration.

* * * * *